US011270567B2

(12) United States Patent
Thomas et al.

(10) Patent No.: US 11,270,567 B2
(45) Date of Patent: Mar. 8, 2022

(54) POOL ENTRY WARNING ASSEMBLY

(71) Applicants: Daniel Thomas, Lincolnton, NC (US); Kevin Duhaime, Lincolnton, NC (US)

(72) Inventors: Daniel Thomas, Lincolnton, NC (US); Kevin Duhaime, Lincolnton, NC (US)

( * ) Notice: Subject to any disclaimer, the term of this patent is extended or adjusted under 35 U.S.C. 154(b) by 171 days.

(21) Appl. No.: 16/742,507

(22) Filed: Jan. 14, 2020

(65) Prior Publication Data

US 2021/0217289 A1 Jul. 15, 2021

(51) Int. Cl.
*G08B 21/08* (2006.01)
*G08B 3/10* (2006.01)

(52) U.S. Cl.
CPC ..... *G08B 21/08* (2013.01); *G08B 3/10* (2013.01)

(58) Field of Classification Search
CPC ..... G08B 21/08; G08B 3/10
USPC ..... 340/573.6
See application file for complete search history.

(56) References Cited

U.S. PATENT DOCUMENTS 3,636,544 A 1/1972 Codina
5,023,593 A * 6/1991 Brox ..... G08B 21/082 340/522
5,548,275 A 8/1996 Shambayati
6,157,304 A * 12/2000 Bennett ..... G08B 21/082 340/522
6,459,218 B2 * 10/2002 Boys ..... H05B 39/00 315/324
7,218,235 B1 5/2007 Rainey
2005/0035866 A1 2/2005 Hatherell
2008/0106422 A1 5/2008 Sparks
2012/0025838 A1 * 2/2012 Lee ..... F21S 8/006 324/501
2014/0015968 A1 1/2014 Elsemore
2016/0042629 A1 2/2016 Snyder
2019/0287378 A1 * 9/2019 Rogers ..... G01S 15/86

* cited by examiner

*Primary Examiner* — Jack K Wang

(57) ABSTRACT

A pool entry warning assembly includes a pool housing has a first portion forming an angle with a second portion thereby facilitating the pool housing to be positioned on an edge of a swimming pool. A motion sensor is coupled to the pool housing to sense motion of an object falling into the swimming pool. An outdoor remote unit is positionable in an area adjacent to the swimming pool and the outdoor remote unit is wireless communication with the motion sensor. The outdoor remote unit emits an audible alarm when the motion sensor senses motion to alert a caregiver that an object has fallen into the swimming pool. A base unit is positionable within a building adjacent to the swimming pool and the base unit is in wireless communication with the motion sensor. The base unit emits an audible alert when the motion sensor senses motion to alert a caregiver that an object has fallen into the swimming pool.

19 Claims, 4 Drawing Sheets

POOL ENTRY WARNING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to pool warning devices and more particularly pertains to a new pool warning device for alerting a caregiver when a child falls into a swimming pool.

(2) Description of Related Art Including Information Disclosed Under 37 CFR 1.97 and 1.98

The prior art relates to pool warning devices. The prior art discloses a fluid pressure alarm that includes a pressure sensor for sensing pressure changes of a fluid. Additionally, the prior art discloses pool monitoring device that includes a seismic sensor, a fluid pressure sensor and an optical sensor for detecting when an object falls into the pool. The prior art discloses a camera device that has the ability to provided adjustment about one or more axis. Additionally, the prior art discloses a pool monitoring system that includes a plurality of wearable sensors that are worn by swimmers in a pool.

BRIEF SUMMARY OF THE INVENTION

An embodiment of the disclosure meets the needs presented above by generally comprising a pool housing has a first portion forming an angle with a second portion thereby facilitating the pool housing to be positioned on an edge of a swimming pool. A motion sensor is coupled to the pool housing to sense motion of an object falling into the swimming pool. An outdoor remote unit is positionable in an area adjacent to the swimming pool and the outdoor remote unit is wireless communication with the motion sensor. The outdoor remote unit emits an audible alarm when the motion sensor senses motion to alert a caregiver that an object has fallen into the swimming pool. A base unit is positionable within a building adjacent to the swimming pool and the base unit is in wireless communication with the motion sensor. The base unit emits an audible alert when the motion sensor senses motion to alert a caregiver that an object has fallen into the swimming pool.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
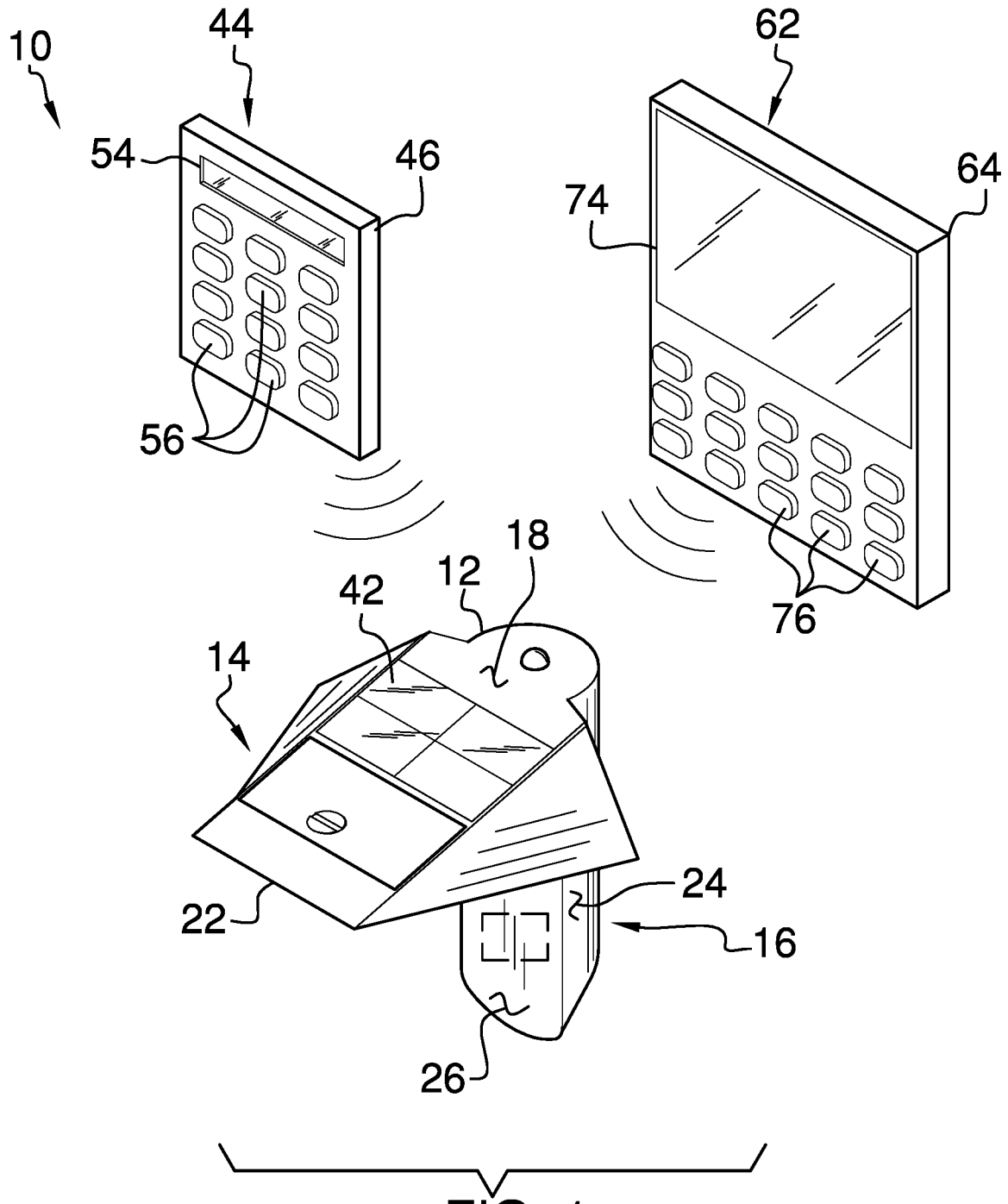
FIG. 1 is a perspective view of a pool entry warning assembly according to an embodiment of the disclosure.
Figure 2:
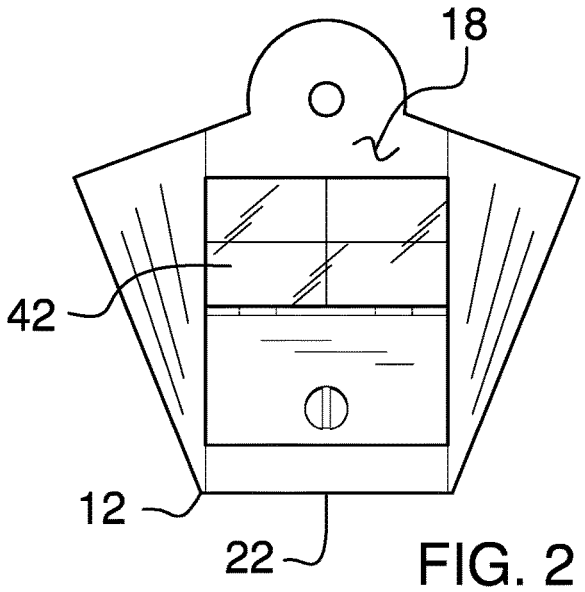
FIG. 2 is a top view of a pool housing of an embodiment of the disclosure.
Figure 3:
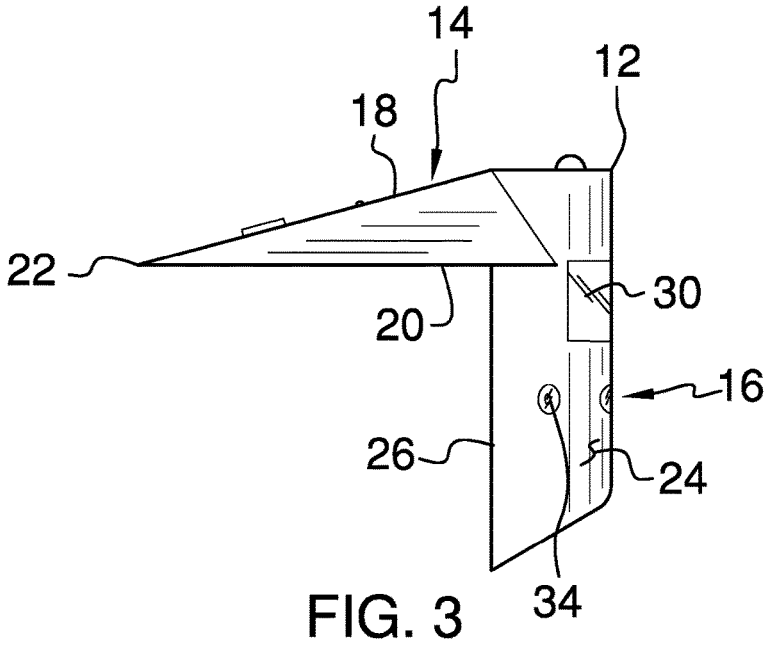
FIG. 3 is a right side view of a pool housing of an embodiment of the disclosure.
Figure 4:
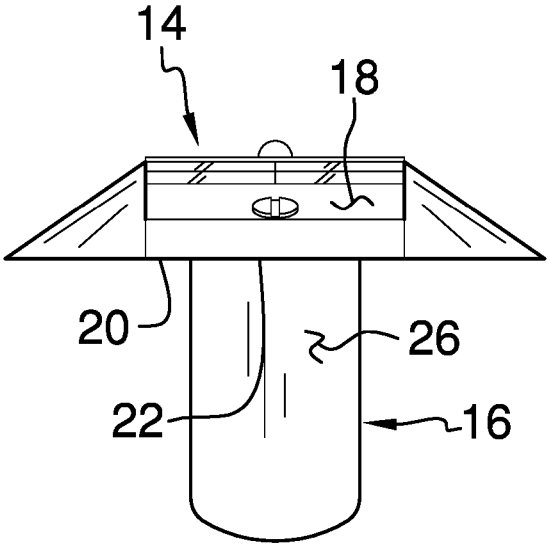
FIG. 4 is a back view of a pool housing of an embodiment of the disclosure.
Figure 5:
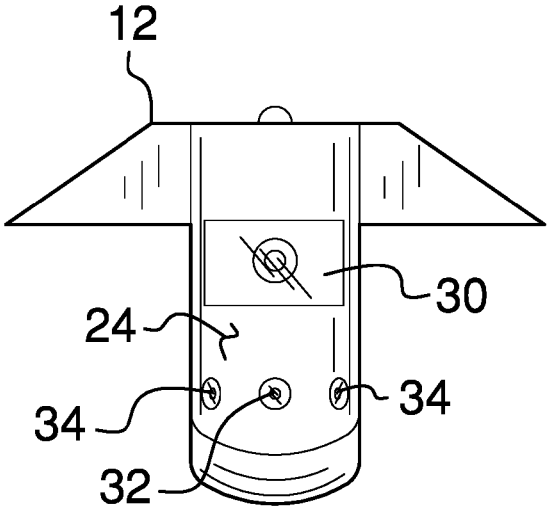
FIG. 5 is a front view of a pool housing of an embodiment of the disclosure.
Figure 6:
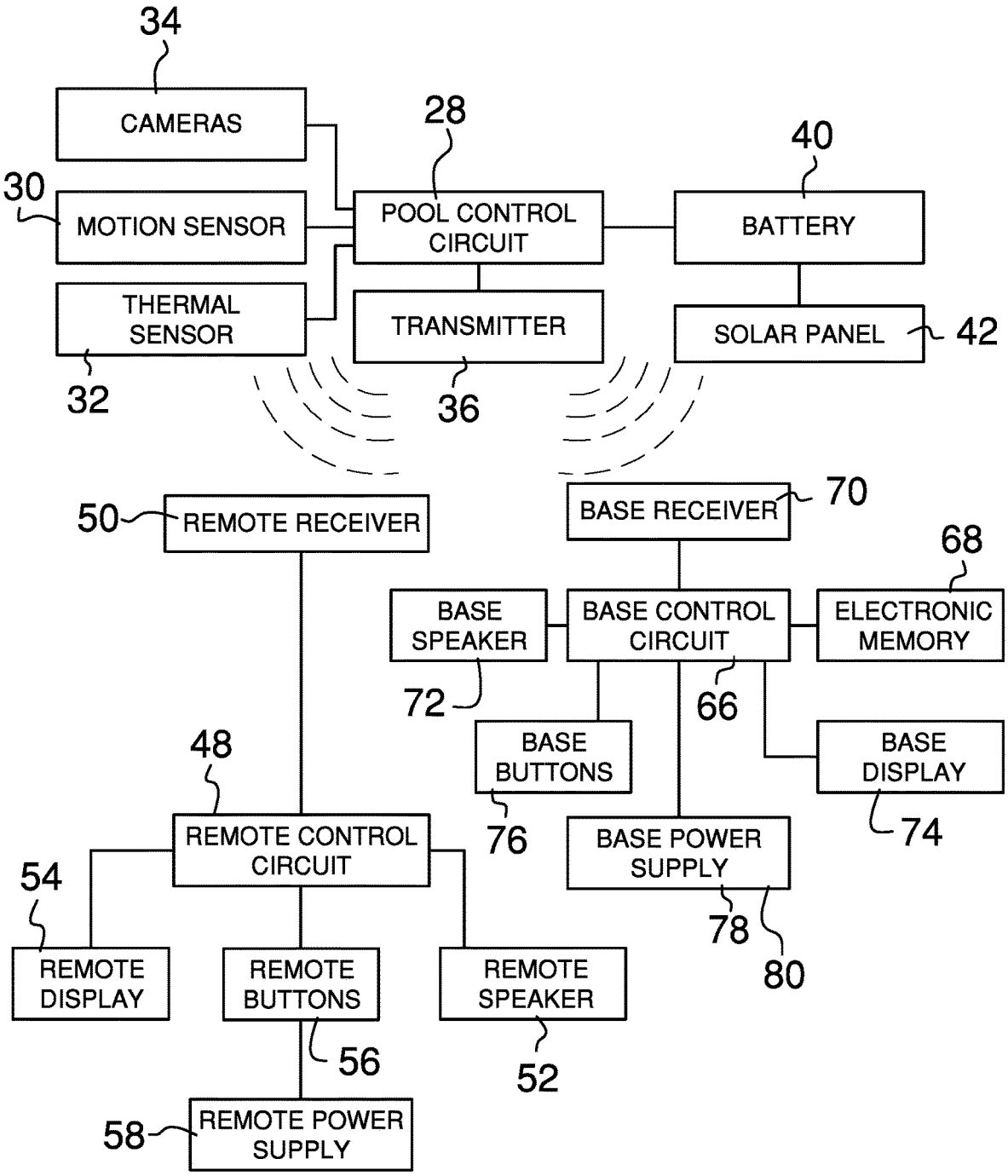
FIG. 6 is a schematic view of an embodiment of the disclosure.

With reference now to the drawings, and in particular to FIGS. 1 through 6 thereof, a new pool warning device embodying the principles and concepts of an embodiment of the disclosure and generally designated by the reference numeral 10 will be described.

As best illustrated in FIGS. 1 through 6, the pool entry warning assembly 10 generally comprises a pool housing 12 that has a first portion 14 forming an angle with a second portion 16 thereby facilitating the pool housing 12 to be positioned on an edge of a swimming pool. The first portion 14 has a top surface 18, a bottom surface 20 and a distal edge 22 with respect to the second portion 16. The top surface 18 slopes upwardly between the distal edge 22 and the first portion 14. The second portion 16 has a forward surface 24 and a rear surface 26, and the forward surface 24 is concavely arcuate with the rear surface 26. The bottom surface 20 of the first portion 14 lies on a horizontal support surface having the rear surface 26 abutting a vertical wall of a swimming pool.

A pool control circuit 28 is positioned in the pool housing 12 and the pool control circuit 28 receives a motion input or a heat input. A motion sensor 30 is coupled to the pool housing 12 and the motion sensor 30 senses motion. The motion sensor 30 is positioned on the second portion 16 of the pool housing 12 such that the motion sensor 30 can sense motion of an object falling into the swimming pool. The motion sensor 30 is positioned on the forward surface 24 of the second portion 16 and the motion sensor 30 is electrically coupled to the pool control circuit 28. Moreover, the pool control circuit 28 receives the motion input when the motion sensor 30 senses motion. The motion sensor 30 may comprise an infra-red motion sensor 30 or other type of electronic motion sensor 30.

A thermal sensor 32 is coupled to the pool housing 12 and the thermal sensor 32 senses heat. The thermal sensor 32 is positioned on the second portion 16 of the pool housing 12 to sense heat in the swimming pool and the thermal sensor 32 is electrically coupled to the pool control circuit 28. Additionally, the pool control circuit 28 receives the heat input when the thermal sensor 32 senses a temperature above a trigger temperature. The thermal sensor 32 may be an electronic thermal sensor 32 and the trigger temperature may be approximately 80.0 degrees Fahrenheit.

A camera 34 is coupled to the pool housing 12 to capture imagery of the swimming pool. The camera 34 is electrically coupled to the pool control circuit 28 and the camera 34 may comprise a digital video camera 34 or the like. A transmitter 36 is coupled to the pool housing 12 and the transmitter 36 is electrically coupled to the pool control circuit 28. The transmitter 36 broadcasts an alert signal when the pool control circuit 28 receives the motion input. The transmitter 36 may comprise a radio frequency transmitter 36 or the like.

A pool power supply 38 is coupled to the pool housing 12 and the pool power supply 38 is electrically coupled to the pool control circuit 28. The pool power supply 38 comprises at least one battery 40 that is positioned within the pool housing 12. The at least one battery 40 is electrically coupled to the pool control circuit 28. The pool power supply 38 includes a solar panel 42 that is coupled to the top surface 18 of the first portion 14 of the pool housing 12 such that the solar panel 42 is exposed to sunlight. The solar panel 42 is electrically coupled to the at least one battery 40 for charging the at least one battery 40.

An outdoor remote unit 44 is provided and the outdoor remote unit 44 is positionable in an area adjacent to the swimming pool. The outdoor remote unit 44 is in wireless communication with the motion sensor 30 and the outdoor remote unit 44 emits an audible alarm when the motion sensor 30 senses motion. In this way the outdoor remote unit 44 alerts a caregiver that an object has fallen into the swimming pool.

The outdoor remote unit 44 comprises a remote housing 46 and a remote control circuit 48 that is positioned in the remote housing 46. The remote control circuit 48 receives an alert input. A remote receiver 50 is positioned in the remote housing 46 and the remote receiver 50 is electrically coupled to the remote control circuit 48. Additionally, the remote receiver 50 is in electrical communication with the transmitter 36 such that the remote receiver 50 receives the alert signal. The remote control circuit 48 receives the alert input when the remote receiver 50 receives the alert signal and the remote receiver 50 may comprise a radio frequency receiver or the like.

A remote speaker 52 is coupled to the remote housing 46 and the remote speaker 52 is electrically coupled to the remote control circuit 48. The remote speaker 52 is turned on to emit an audible alarm when the remote control circuit 48 receives the alert input. A remote display 54 is coupled to the remote housing 46 and the remote display 54 is electrically coupled to the remote control circuit 48. The remote display 54 remote displays indicia comprising operational parameters of the remote control circuit 48. The remote display 54 may comprise an LED or other type of electronic display.

A plurality of remote buttons 56 is each movably coupled to the remote housing 46 and each of the remote buttons 56 is electrically coupled to the remote control circuit 48. The remote buttons 56 programs operational parameters of the remote control circuit 48. The plurality of remote buttons 56 is manipulated to enter a pre-determined code into the remote control circuit 48 for accessing restricted functions of the remote control circuit 48. A remote power supply 58 is positioned in the remote housing 46, the remote power supply 58 is electrically coupled to the remote control circuit 48 and the remote power supply 58 comprises at least one battery 60.

A base unit 62 is provided and the base unit 62 is positionable within a building adjacent to the swimming pool. The base unit 62 is in wireless communication with the motion sensor 30 and the base unit 62 emits an audible alert when the motion sensor 30 senses motion. In this way the base unit 62 can alert a caregiver that an object has fallen into the swimming pool. The base unit 62 comprises a base housing 64 and a base control circuit 66 that is positioned in the base housing 64. The base control circuit 66 receives an alarm input. An electronic memory 68 is positioned in the base housing 64 and the electronic memory 68 is electrically coupled to the base control circuit 66.

A base receiver 70 is positioned in the base housing 64 and the base receiver 70 is electrically coupled to the base control circuit 66. The base receiver 70 is in electrical communication with the transmitter 36 and the base receiver 70 receives the alert signal from the transmitter 36. Moreover, the base control circuit 66 receives the alarm input when the base receiver 70 receives the alert signal. The base receiver 70 receives imagery captured by the camera 34 for storage in the electronic memory 68. The base receiver 70 may comprise a radio frequency receiver or the like.

A base speaker 72 is coupled to the base housing 64 and the base speaker 72 is turned on to emit an audible alarm when the base control circuit 66 receives the alarm input. A base display 74 is coupled to the base housing 64 and the base display 74 is electrically coupled to the base control circuit 66. The base display 74 is electrically coupled to the base control circuit 66 and the base display 74 displays indicia comprising operational parameters of the remote control circuit 48. The base display 74 may comprise an LED or other type of electronic display.

A plurality of base buttons 76 is each movably coupled to the base housing 64 and each of the base buttons 76 is electrically coupled to the base control circuit 66. The base buttons 76 program operational parameters of the base control circuit 66. Additionally, the plurality of base buttons 76 can be manipulated to enter a pre-determined code into the base control circuit 66 for accessing restricted functions of the base control circuit 66. A base power supply 78 is positioned in the base housing 64, the base power supply 78 is electrically coupled to the base control circuit 66 and the base power supply 78 comprising at least one battery 80.

In use, the pool housing 12 is positioned on the edge of the swimming pool such that the motion sensor 30 is directed over the surface of water in the swimming pool. In this way the motion sensor 30 can sense the motion of an object falling into the swimming pool. The remote speaker 52 and the base speaker 72 emit the audible alarm when the motion sensor 30 senses motion or when the thermal sensor 32 senses heat. In this way the caregiver is notified that an object, and potentially a child, has fallen into the swimming pool. Thus, the caregiver can immediately investigate the swimming pool for the child or the object.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A pool entry warning assembly being configured to alert a caregiver when a child falls into a swimming pool, said assembly comprising:

a pool housing having a first portion forming an angle with a second portion thereby facilitating said pool housing to be positioned on an edge of a swimming pool;

a motion sensor being coupled to said pool housing wherein said motion sensor is configured to sense motion, said motion sensor being positioned on said second portion of said pool housing wherein said motion sensor is configured to sense motion of an object falling into the swimming pool;

a thermal sensor being coupled to said pool housing wherein said thermal sensor is configured to sense heat, said thermal sensor being positioned spaced below said motion sensor;

a camera being coupled to said pool housing wherein said camera is configured to capture imagery of the swimming pool, said camera being positioned laterally spaced from said thermal sensor wherein said camera and said thermal sensor are positioned in a first plane, said thermal sensor and said motion sensor being positioned within a second plane, said first plane being perpendicular to said second plane;

an outdoor remote unit being positionable in an area adjacent to the swimming pool, said outdoor remote unit being wireless communication with said motion sensor, said outdoor remote unit emitting an audible alarm when said motion sensor senses motion wherein said outdoor remote unit is configured to alert a caregiver that an object has fallen into the swimming pool; and a base unit being positionable within a building adjacent to the swimming pool, said base unit being in wireless communication with said motion sensor, said base unit emitting an audible alert when said motion sensor senses motion wherein said base unit is configured to alert a caregiver that an object has fallen into the swimming pool.

2. The assembly according to claim 1, wherein said first portion has a top surface, a bottom surface and a distal edge with respect to said second portion, said top surface sloping upwardly between said distal edge and said first portion, said second portion having a forward surface and a rear surface, said forward surface being concavely arcuate with said rear surface, said bottom surface of said first portion lying on a horizontal support surface having said rear surface abutting a vertical wall of a swimming pool.

3. The assembly according to claim 1, further comprising a pool control circuit being positioned in said pool housing, said pool control circuit receiving a motion input or a heat input.

4. The assembly according to claim 3, wherein:

said pool housing has a first portion and a second portion, said second portion having forward surface; and said motion sensor is positioned on said forward surface of said second portion, said motion sensor being electrically coupled to said pool control circuit, said pool control circuit receiving said motion input when said motion sensor senses motion.

5. The assembly according to claim 3, wherein:

said pool housing has a first portion and a second portion; and said thermal sensor is positioned on said second portion of said pool housing wherein said thermal sensor is configured to sense heat in the swimming pool, said thermal sensor being electrically coupled to said pool control circuit, said pool control circuit receiving said heat input when said thermal sensor senses a temperature above a trigger temperature.

6. The assembly according to claim 3, further comprising a transmitter being coupled to said pool housing, said transmitter being electrically coupled to said pool control circuit, said transmitter broadcasting an alert signal when said pool control circuit receives said motion input.

7. The assembly according to claim 3, further comprising a pool power supply being coupled to said pool housing, said pool power supply being electrically coupled to said pool control circuit, said pool power supply comprising:

at least one battery being positioned within said pool housing, said at least one battery being electrically coupled to said pool control circuit; and a solar panel being coupled to said top surface of said first portion of said pool housing wherein said solar panel is configured to be exposed to sunlight, said solar panel being electrically coupled to said at least one battery for charging said at least one battery.

8. The assembly according to claim 6, wherein said outdoor remote unit comprising:

a remote housing;

a remote control circuit being positioned in said remote housing, said remote control circuit receiving an alert input; and a remote receiver being positioned in said remote housing, said remote receiver being electrically coupled to said remote control circuit, remote receiver being in electrical communication with said transmitter such that said remote receiver receives said alert signal, said remote control circuit receiving said alert input when said remote receiver receives said alert signal.

9. The assembly according to claim 8, wherein said outdoor remote unit includes a remote speaker being coupled to said remote housing, said remote speaker being electrically coupled to said remote control circuit, said remote speaker being turned on to emit an audible alarm when said remote control circuit receives said alert input.

10. The assembly according to claim 8, wherein said outdoor remote unit includes a remote display being coupled to said remote housing, said remote display being electrically coupled to said remote control circuit, said remote display remote displaying indicia comprising operational parameters of said remote control circuit.

11. The assembly according to claim 8, wherein said outdoor remote unit includes a plurality of remote buttons, each of said remote buttons being movably coupled to said remote housing, each of said remote buttons being electrically coupled to said remote control circuit, said remote buttons programming operational parameters of said remote control circuit, said plurality of remote buttons being manipulated to enter a pre-determined code into said remote control circuit for accessing restricted functions of said remote control circuit.

12. The assembly according to claim 8, wherein said outdoor remote unit includes a remote power supply being positioned in said remote housing, said remote power supply being electrically coupled to said remote control circuit, said remote power supply comprising at least one battery.

13. The assembly according to claim 1, wherein said base unit comprising:

a base housing;

a base control circuit being positioned in said base housing, said base control circuit receiving an alarm input; and an electronic memory being positioned in said base housing, said electronic memory being electrically coupled to said base control circuit.

14. The assembly according to claim 13, wherein said base unit comprises a base receiver being positioned in said base housing, said base receiver being electrically coupled to said base control circuit, said base receiver being in electrical communication with said transmitter, said base receiver receiving said alert signal from said transmitter, said base control circuit receiving said alarm input when said base receiver receives said alert signal, said base receiver receiving imagery captured by said camera for storage in said electronic memory.

15. The assembly according to claim 13, wherein said base unit includes a base speaker being coupled to said base housing, said base speaker being turned on to emit an audible alarm when said base control circuit receives said alarm input.

16. The assembly according to claim 13, wherein said base unit includes a base display being coupled to said base housing, said base display being electrically coupled to said base control circuit, said base display being electrically coupled to said base control circuit, said base display displaying indicia comprising operational parameters of said remote control circuit.

17. The assembly according to claim 13, wherein said base unit includes a plurality of base buttons, each of said base buttons being movably coupled to said base housing, each of said base buttons being electrically coupled to said base control circuit, said base buttons programming operational parameters of said base control circuit, said plurality of base buttons being manipulated to enter a pre-determined code into said base control circuit for accessing restricted functions of said base control circuit.

18. The assembly according to claim 13, wherein said base unit includes a base power supply being positioned in said base housing, said base power supply being electrically coupled to said base control circuit, said base power supply comprising at least one battery.

19. A pool entry warning assembly being configured to alert a caregiver when a child falls into a swimming pool, said assembly comprising:

a pool housing having a first portion forming an angle with a second portion thereby facilitating said pool housing to be positioned on an edge of a swimming pool, said first portion having a top surface, a bottom surface and a distal edge with respect to said second portion, said top surface sloping upwardly between said distal edge and said first portion, said second portion having a forward surface and a rear surface, said forward surface being concavely arcuate with said rear surface, said bottom surface of said first portion lying on a horizontal support surface having said rear surface abutting a vertical wall of a swimming pool;

a pool control circuit being positioned in said pool housing, said pool control circuit receiving a motion input or a heat input;

a motion sensor being coupled to said pool housing wherein said motion sensor is configured to sense motion, said motion sensor being positioned on said second portion of said pool housing wherein said motion sensor is configured to sense motion of an object falling into the swimming pool, said motion sensor being positioned on said forward surface of said second portion, said motion sensor being electrically coupled to said pool control circuit, said pool control circuit receiving said motion input when said motion sensor senses motion;

a thermal sensor being coupled to said pool housing wherein said thermal sensor is configured to sense heat, said thermal sensor being positioned on said second portion of said pool housing wherein said thermal sensor is configured to sense heat in the swimming pool, said thermal sensor being electrically coupled to said pool control circuit, said pool control circuit receiving said heat input when said thermal sensor senses a temperature above a trigger temperature, said thermal sensor being positioned spaced below said motion sensor;

a camera being coupled to said pool housing wherein said camera is configured to capture imagery of the swimming pool, said camera being electrically coupled to said pool control circuit, said camera being positioned laterally spaced from said thermal sensor wherein said camera and said thermal sensor are positioned in a first plane, said thermal sensor and said motion sensor being positioned within a second plane, said first plane being perpendicular to said second plane;

a transmitter being coupled to said pool housing, said transmitter being electrically coupled to said pool control circuit, said transmitter broadcasting an alert signal when said pool control circuit receives said motion input;

a pool power supply being coupled to said pool housing, said pool power supply being electrically coupled to said pool control circuit, said pool power supply comprising:

at least one battery being positioned within said pool housing, said at least one battery being electrically coupled to said pool control circuit; and a solar panel being coupled to said top surface of said first portion of said pool housing wherein said solar panel is configured to be exposed to sunlight, said solar panel being electrically coupled to said at least one battery for charging said at least one battery;

an outdoor remote unit being positionable in an area adjacent to the swimming pool, said outdoor remote unit being wireless communication with said motion sensor, said outdoor remote unit emitting an audible alarm when said motion sensor senses motion wherein said outdoor remote unit is configured to alert a caregiver that an object has fallen into the swimming pool, said outdoor remote unit comprising:

a remote housing;

a remote control circuit being positioned in said remote housing, said remote control circuit receiving an alert input;

a remote receiver being positioned in said remote housing, said remote receiver being electrically coupled to said remote control circuit, remote receiver being in electrical communication with said transmitter such that said remote receiver receives said alert signal, said remote control circuit receiving said alert input when said remote receiver receives said alert signal;

a remote speaker being coupled to said remote housing, said remote speaker being electrically coupled to said remote control circuit, said remote speaker being turned on to emit an audible alarm when said remote control circuit receives said alert input;

a remote display being coupled to said remote housing, said remote display being electrically coupled to said remote control circuit, said remote display remote displaying indicia comprising operational parameters of said remote control circuit;

a plurality of remote buttons, each of said remote buttons being movably coupled to said remote housing, each of said remote buttons being electrically coupled to said remote control circuit, said remote buttons programming operational parameters of said remote control circuit, said plurality of remote buttons being manipulated to enter a pre-determined code into said remote control circuit for accessing restricted functions of said remote control circuit; and a remote power supply being positioned in said remote housing, said remote power supply being electrically coupled to said remote control circuit, said remote power supply comprising at least one battery; and a base unit being positionable within a building adjacent to the swimming pool, said base unit being in wireless communication with said motion sensor, said base unit emitting an audible alert when said motion sensor senses motion wherein said base unit is configured to alert a caregiver that an object has fallen into the swimming pool, said base unit comprising:

a base housing;

a base control circuit being positioned in said base housing, said base control circuit receiving an alarm input;

an electronic memory being positioned in said base housing, said electronic memory being electrically coupled to said base control circuit;

a base receiver being positioned in said base housing, said base receiver being electrically coupled to said base control circuit, said base receiver being in electrical communication with said transmitter, said base receiver receiving said alert signal from said transmitter, said base control circuit receiving said alarm input when said base receiver receives said alert signal, said base receiver receiving imagery captured by said camera for storage in said electronic memory;

a base speaker being coupled to said base housing, said base speaker being turned on to emit an audible alarm when said base control circuit receives said alarm input;

a base display being coupled to said base housing, said base display being electrically coupled to said base control circuit, said base display being electrically coupled to said base control circuit, said base display displaying indicia comprising operational parameters of said remote control circuit;

a plurality of base buttons, each of said base buttons being movably coupled to said base housing, each of said base buttons being electrically coupled to said base control circuit, said base buttons programming operational parameters of said base control circuit, said plurality of base buttons being manipulated to enter a pre-determined code into said base control circuit for accessing restricted functions of said base control circuit; and a base power supply being positioned in said base housing, said base power supply being electrically coupled to said base control circuit, said base power supply comprising at least one battery.

* * * * *